United States Patent [19]

Ray et al.

[11] Patent Number: 4,662,619

[45] Date of Patent: May 5, 1987

[54] KNEELING ATTACHMENT FOR OPERATIONS IN THE PRONE SITTING POSITION

[75] Inventors: Charles D. Ray, Wayzata; Richard G. Steller, Deephaven, both of Minn.

[73] Assignee: Charles D. Ray, Ltd., Wayzata, Minn.

[21] Appl. No.: 853,667

[22] Filed: Apr. 18, 1986

Related U.S. Application Data

[63] Continuation-in-part of Ser. No. 705,899, Feb. 26, 1985, abandoned.

[51] Int. Cl.[4] ..... A61G 13/00

[52] U.S. Cl. ..... 269/328

[58] Field of Search ..... 269/328, 322–327; 128/133, 134; 5/431, 443, 444

[56] References Cited

U.S. PATENT DOCUMENTS

| | | | |
|---|---|---|---|
| 2,577,177 | 12/1951 | Anderson . | |
| 2,581,110 | 1/1952 | Kenworthy | 5/444 |
| 2,878,493 | 3/1959 | Delia | 5/444 |
| 2,895,775 | 7/1959 | McDonald et al. . | |
| 3,289,674 | 12/1966 | Platt . | |
| 3,372,921 | 3/1968 | Anderson . | |
| 3,532,336 | 10/1970 | Baker | 5/443 |
| 3,643,938 | 2/1972 | Levasseur . | |
| 3,946,451 | 3/1976 | Spunn | 5/443 |
| 4,275,472 | 6/1981 | Erck | 5/443 |
| 4,391,438 | 7/1983 | Heffington | 269/328 |
| 4,398,707 | 8/1983 | Cloward | 269/328 |
| 4,426,071 | 1/1984 | Klevstad | 269/328 |
| 4,444,381 | 4/1984 | Wayne | 269/328 |

OTHER PUBLICATIONS

Catalogue, "Andrews Spinal Frame", Orthopedic Systems Inc.

Catalogue, "The Maquet Operating Table System", Stierlen-Maquet Ag.

*Primary Examiner*—Robert C. Watson

*Attorney, Agent, or Firm*—Williamson, Bains, Moore & Hansen

[57] ABSTRACT

For operations in the prone sitting position, the novel kneeling attachment has a lower-leg platform from which one or a pair of posts project downwardly to rest against the floor to support the lower portion of the patient's body while his or her upper body is moved up or down relative to the buttocks by vertically moving the operating table. After thus adjusting the attitude of the patient's backbone, the lower-leg platform is locked, and the operating table can be moved to whatever height is most comfortable to the surgeon. The lower-leg platform of the kneeling attachment includes cushioning which is formed with two longitudinal channels that conform to the lower legs of a patient. A spacing between the lower-leg platform and the foot of the operating table leaves the kneecaps substantially unsupported, so that the patient's weight primarily rests on the tibial plateaus. The kneeling attachment may include a buttocks support which comprises a U-shaped yoke, the crosspiece of which carries a seat pad and the arms of which carry elongated, generally cylindrical cushions. Each of these cushions is formed with an off-center bore so that rotation of the cushions accommodates patients of differing hip sizes.

19 Claims, 12 Drawing Figures

KNEELING ATTACHMENT FOR OPERATIONS IN THE PRONE SITTING POSITION

CROSS REFERENCE TO RELATED APPLICATION

This application is a continuation-in-part of applicants' copending application Ser. No. 705,899 filed Feb. 26, 1985, now abandoned.

FIELD OF THE INVENTION

The invention concerns a kneeling attachment to an operating table to enable the patient to assume a prone sitting position.

BACKGROUND ART

For operations with the patient in the prone sitting position, an ordinary operating table is fitted with a kneeling attachment such as that illustrated in a brochure entitled "Andrews Spinal Surgery Frame" of Orthopedic Systems, Inc., Hayward, Calif. The Andrews frame, which is currently in widespread use, includes a rigid thigh support having a rail along each side, means pivotably attaching one end of the thigh support to an end of the operating table, a rigid lower-leg-supporting platform including slides riding on said rails, and means for releasably locking the slides to the rails. While a patient is lying on the operating table as shown in FIG. 9 of the brochure, the attachment is pivoted downwardly as shown in FIG. 12 to place the patient in the prone sitting position. Usually the patient's backbone should be horizontal, and to adjust the attachment to do so, the Andrews frame includes a rack-and-pinion drive for sliding the lower-leg platform up and down along the rails of the thigh support. Partly because of the rack-and-pinion drive, the Andrews frame is exceedingly heavy and hence is wheeled about on a cart as shown in FIG. 2 of the brochure.

Kneeling attachments which are more or less similar to that of the Andrews brochure are shown in U.S. Pat. Nos. 2,577,177 (Anderson); 3,372,921 (Anderson); 2,895,775 (McDonald et al.); 3,289,674 (Platt); 4,391,438 (Heffington); and 4,398,707 (Cloward). Some of these incorporate mechanisms which like that of Andrews mechanically raise the lower-leg platform. For example, McDonald's includes a screw along each side of the thigh support. In others such as Cloward's which have no such mechanism, it would be unreasonable to attempt to raise or lower the lower-leg platform without first freeing it from the patient's weight.

When in the prone sitting position, the patient's lower legs usually rest on a flat cushion on a flat platform. For example, see the cushion 71 in FIG. 1 of U.S. Pat. No. 2,577,177 (Anderson); the cushion 22 in FIG. 1 of U.S. Pat. No. 3,643,938 (Levasseur); and the cushion 42 in FIG. 1 of U.S. Pat. No. 4,398,707 (Cloward). The same arrangement is illustrated in the aforementioned "Andrews Spinal Surgery Frame" brochure. During an operation using the Andrews frame, the patient's lower legs are necessarily securely strapped to the lower-leg platform, usually together, making it awkward to release either leg should it be desired to move that leg. The weight of the patient's hip area largely bears on the kneecaps which can become inordinately uncomfortable in a long operation.

Instead of being flat, the lower-leg platform of U S. Pat. No. 3,289,674 (Platt) comprises "L-shaped supporting frames 70 and 71, respectively, which are each provided with suitable padding 72 for the comfort of the patient" (col. 4, lines 32–36). Somewhat similar to the padded L-shaped supporting frames of the Platt patent are the kneeling frames pictured at page 13 of a brochure entitled "The Maquet Operating Table System", Catalogue No. 1120 of Stierlen-Maquet AG, Rastatt, Federal Republic of Germany. While that picture lacks details, Maquet's kneeling frames (as compared to those of the Platt patent) have deeper depressions which appear to be contoured to provide lateral support for much of the lower leg. Like the flat cushions cited above, both Maquet's and Platt's kneeling frames appear to entail considerable weight on the kneecaps.

When a patient is in the prone sitting position, the buttocks usually rest against a seat pad as shown in the aforementioned "Andrews Spinal Surgery Frame" brochure. As also illustrated there, the buttocks may be laterally supported by two cylindrical cushions, but often have no lateral support, as in U.S. Pat. No. 4,391,438 (Heffington). Instead of using cushions, straps may be wrapped around the thighs, either in combination with a seat pad or without as in U.S. Pat. Nos. 3,643,938 (Levasseur) or No. 2,577,177 (Anderson).

DISCLOSURE OF INVENTION

The present invention concerns a kneeling attachment which is similar to that of the Andrews brochure in that it can be attached to an operating table that can be hydraulically raised and lowered relative to the floor of an operating room. A typical operating table has a foot hinged between a horizontal and a vertical position and a rail along each side of the foot. A rigid lower-leg-supporting platform includes a slide riding on each of the rails and means for releasably locking the slides to the rails. The kneeling attachment of the invention differs from the Andrews frame in that:

at least one post is attached to the lower-leg platform and, when said foot is in the vertical position, the post can rest on the floor to support a patient in the prone sitting position, thus permitting the slides to be unlocked and the operating table to be raised or lowered to position the patient's upper body relative to the buttocks.

In a preferred kneeling attachment of the invention, said at least one post is a pair of rigidly interconnected posts which are hinged to pivot between a position extending downwardly, when said foot is in the vertical postion, and a retracted position. The hinge of each post is automatically locked when pressure is longitudinally applied to the free end of its post while the posts are in the extended position. Hence, when the operating table is lowered by the usual hydraulic mechanism while the slides are locked to the rails of the thigh support and the posts are extending downwardly, the hinges automatically lock when the posts contact the floor. Upon then unlocking the slides, the posts bear the full weight of the lower half of the patient's body plus the kneeling attachment. The hydraulic mechanism can then raise or lower the patient's upper body relative to the buttocks until the patient's backbone is horizontal or in some other desired attitude. After again locking the slides to the rails of the thigh support, the operating table is hydraulically raised to allow the free ends of the posts to be retracted, after which the operating table with the kneeling attachment can be raised or lowered to whatever height is most comfortable to the surgeon.

Because the post or pair of posts are the only addition to the simplest possible kneeling attachment, the novel kneeling attachment can be of sturdy, lightweight construction and easily mounted or dismounted by a single person. Only gravity, in addition to the integral hydraulic raising-lowering mechanism of an ordinary operating table, is used to adjust the attitude of the backbone of a patient in the prone sitting position.

After adjusting the attitude of the patient's backbone, the foot of the operating table can be rotated about its pivotal attachment to the operating table to move the patient into any of the positions illustrated in the prior art cited above.

The lower-leg platform of the kneeling attachment of the invention, like that shown in the aforementioned Andrews brochure, has cushioning for the comfort of a patient who is kneeling on the platform. Unlike that of Andrews the cushioning is formed with two longitudinal channels of substantially semi-circular cross section, each channel being open at each end and constricted toward the ankle end to provide under and lateral support to the patient's lower leg over much of its length, and the kneeling attachment includes means spacing the lower-leg platform from the foot of the operating table to leave the kneecaps substantially unsupported.

By leaving the kneecaps substantially unsupported, the weight of the patient's buttocks and hips rest primarily on the tibial plateau of each lower leg, and this should be much more comfortable to the patient in a long operation.

The cushioning of the lower-leg platform may be a single leg cushion, or two leg cushions, each formed with a substantially semi-cylindrical channel. Preferably the lower-leg platform is formed with a depression or depressions into which the leg cushion or cushions fit. This, in combination with the two longitudinal channels in the cushioning, eliminates any danger of the patient's legs slipping off either side of the lower-leg platform. Then by securing each of the patient's legs separately, either leg can be freed and moved about, e.g., to move nerves in the course of an operation or to release adhesions immediately following the operation.

Preferably the constricted portion of each channel toward the ankle end lifts the ankle at least to the position to which it naturally rises when the tibial plateau is resting on a flat surface. Additionally, the knee end of the lower-leg platform immediately beneath each channel may have a gently convex extension toward the foot of the operating table, and the cushioning may have a corresponding extension in order to cradle that portion of the lower leg between the kneecap and the tibial plateau. For economy of manufacture, the lower-leg platform of the kneeling attachment of the invention may be a single rigid panel of lightweight construction, preferably including reinforcing members beneath the panel across its knee end and its ankle end. This helps to minimize the weight of the kneeling attachment.

Preferably the kneeling attachment of the invention includes a buttocks support comprising:

- a rigid U-shaped yoke, each arm of which can be telescopically locked to the operating table and has a straight section on which is removably mounted a resilient side cushion having
  - a generally cylindrical surface, a length no greater than that of the straight section, and an off-center longitudinal bore into which the straight section fits, and
  - a seat pad pivotably mounted on the crosspiece of the yoke.

Each side cushion may be slit from from its exterior surface to the bore over its full length to permit it to be removably slipped onto a straight section of the yoke. Preferably both the bore and the yoke have circular cross sections, and the diameter of the bore is less than that of the yoke so that there is an open wedge at the slit when the side cushion is slipped onto the yoke. Each side cushion may include at least one strap means such as a hook-and-loop fastener for tightening the strap until the side cushion grips the yoke against rotational or longitudinal movement. When the strap means are unfastened, the side cushions may be rotated to accommodate patients of differing hip sizes.

Preferably, the seat pad is removably mounted on and can be securely locked in position on the crosspiece of the yoke.

THE DRAWING

In the drawing, FIGS. 1–5 schematically illustrate a preferred kneeling attachment of the invention. Specifically:

Figure 1:
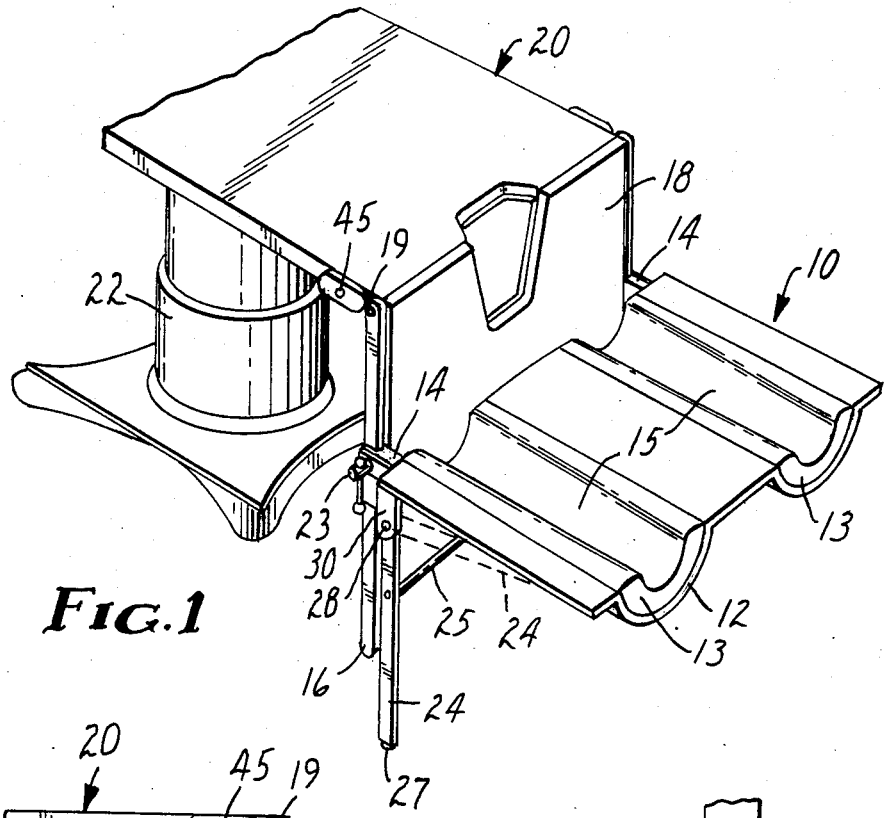
FIG. 1 is a perspective of the kneeling attachment mounted on an ordinary operating table.

Referring first to FIG. 1, a kneeling attachment 10 has a lower-leg-supporting platform 12 formed with two depressions, into each of which is fitted a cushion 13. The upper surface of each cushion is formed with a longitudinal channel 15 of substantially semi-circular cross section. Each channel is open at each end and constricted toward the ankle end to conform to the anatomy of the lower leg of a kneeling patient. The lower-leg platform 12 includes a pair of slides 14, each containing a roller bearing (not shown) at each of its four corners, which bearings ride on the rails 16 at the sides of a foot 18 of an operating table 20. As can be seen in both FIG. 1 and FIG. 2, the lower-leg platform 12 is spaced from the foot 18 of the operating table to leave the kneecaps substantially unsupported. The foot 18 can be pivoted on a hinge 19 between a vertical position (as shown in FIG. 1) and a horizontal position. The operating table 20 can be raised and lowered by a hydraulic lift 22 which is an integral part of the operating table. Each of the slides 14 can be locked to one of the rails 16 by a threaded clamp 23.

Figure 2:
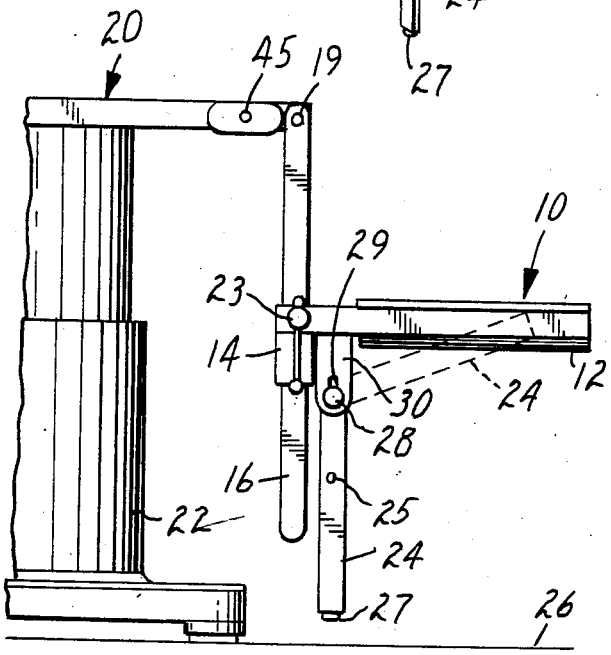
FIG. 2 is a fragmentary side elevation of the operating table and kneeling attachment, slightly enlarged.

In FIG. 2, the clamps 23 have been tightened to position the lower-leg platform 12 at an elevation permitting a pair of pivotable posts 24 to be in the extended position without touching the floor 26. The posts 24 move together in that they are rigidly interconnected by a crossbrace 25. Each post has a resilient pad 27 to prevent slipping when they contact the floor. Fixed to each post 24 is a hinge-pin 28 which fits through a keyhole 29 in a rigid arm 30 that extends downwardly from the lower-leg platform 12. Part of each hinge-pin 28 has flat surfaces 31 which slidably fit against the neck of the keyhole 29 (as in FIG. 3) when the posts 24 are extending downwardly and pressure is longitudinally applied to the free ends of the posts. This locks the posts in the downwardly extended position, for reasons of safety, until the pressure is released, whereupon the posts may be retracted to the dotted position indicated in FIGS. 1 and 2.

Figure 4:
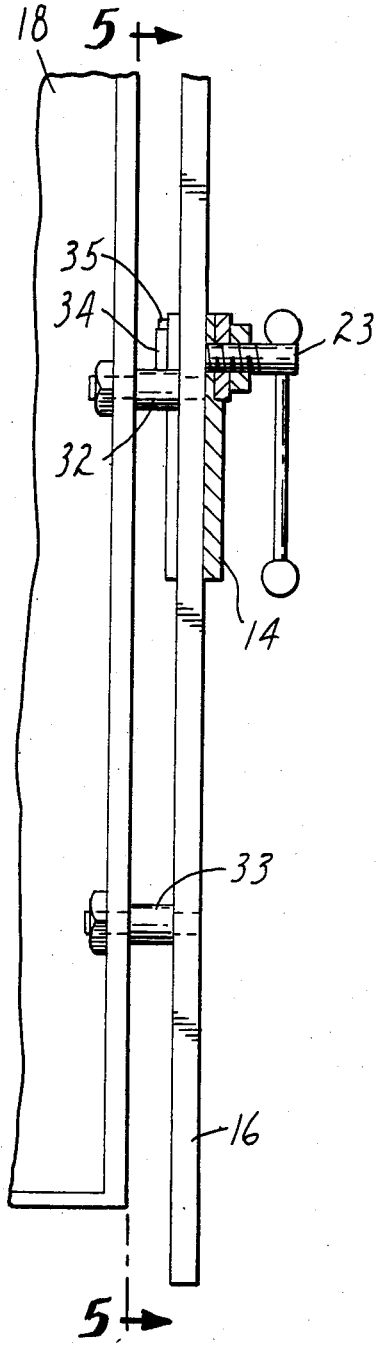
FIG. 4 is an end elevation, further enlarged to show details of the mechanism for clamping the lower-leg platform to rails at the sides of the foot of the operating table, a portion being in section.
Figure 5:
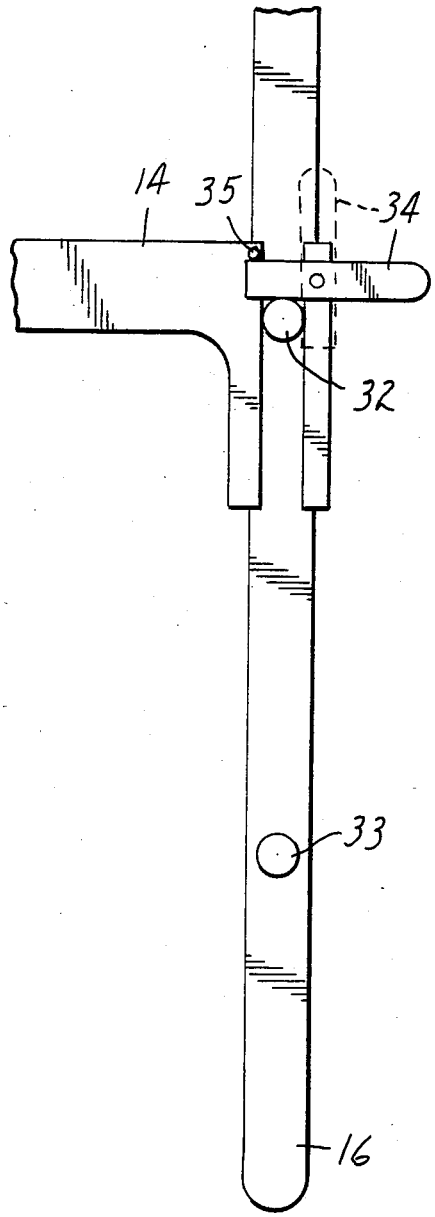
FIG. 5 is a view as seen from line 5—5 of FIG. 4 showing details of a safety mechanism for preventing the lower-leg platform from accidentally falling.

Each of the rails 16 is fastened to the foot 18 of the operating table 20 by a pair of pins 32,33 which space the rails from the thigh support as seen in FIG. 4. A pivotable catch 34 on each slide 14 extends into that space and is caused by gravity to assume a horizontal position with one end resting against a pin 35 (FIG. 5) which protrudes from the slide. In that position the catch 34 stops the lower-leg platform 12 from moving downwardly past either the pin 32 (as shown in FIG. 5) or the pin 33 unless the catch 34 is manually pivoted to a vertical position.

Figure 3:
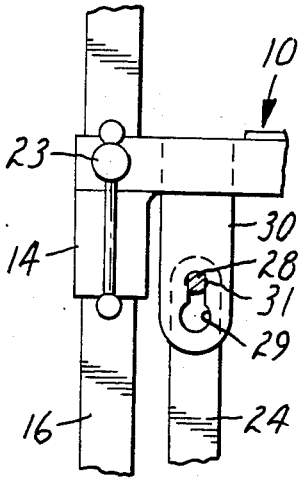
FIG. 3 is a further enlarged fragmentary view similar to that of FIG. 2, showing details of mechanism for locking the posts which project downwardly from the lower-leg platform of the kneeling attachment.

To use the illustrated kneeling attachment 10, the foot 18 of the operating table 20 may be set in the vertical position with the lower-leg platform 12 high enough above the floor 26 to permit the posts 24 to be pivoted to the vertically extended position shown in FIGS. 1 and 2. With the clamps 23 locking the slides 14 to the rails 16 and a patient in the prone sitting position, the posts 24 hang freely in the extended position. Then the hydraulic lift 22 lowers the bed of the operating table 20 until the posts engage the floor, applying pressure longitudinally to the free ends of the posts to cause each hinge-pin 28 to slide into the neck of its keyhole 29 with the flat surfaces 31 of the hinge-pin locking the post as shown in FIG. 3. The clamps 23 are then released, thus placing on the posts 24 the full weight of the lower half of the patient's body plus the kneeling attachment 10. The bed of the operating table 20 can then be raised or lowered by the hydraulic lift 22, thus raising or lowering the patient's upper body relative to the buttocks until the patient's backbone is horizontal or in some other desired attitude. The clamps 23 are again locked, and the operating table is raised sufficiently to allow the free ends of the posts 24 to be retracted, after which the operating table can be raised or lowered to whatever height is most comfortable to the surgeon.

Figure 6:
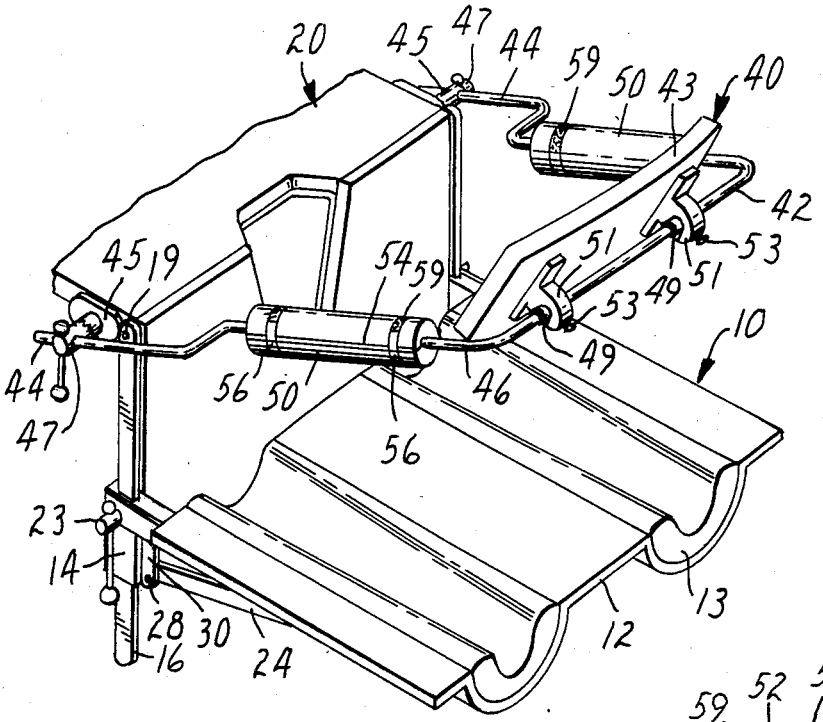
FIG. 6 is a schematic perspective of a kneeling attachment of the invention including a buttocks support.
Figure 7:
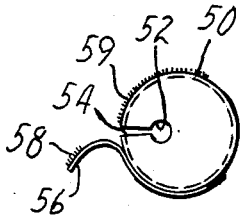
FIG. 7 is an end view of a side cushion of the buttocks support shown in FIG. 6.

Reference is now made to FIG. 6, showing the kneeling attachment 10 of FIGS. 1–5 to which a buttocks support 40 has been attached. The buttocks support 40 has a rigid U-shaped yoke 42 of circular cross section which carries a pivotable seat pad 43. The ends 44 of the yoke 42 telescopically fit into castellated mounts 45 by which the yoke may be pivoted up or down and locked in place by a clamp 47. Welded to the crosspiece of the yoke 42 are two collars 49, to each of which is detachably clamped a C-shaped mount 51 of the seat pad 43. A winged set screw 53 on each of the mounts 51 locks the position of the seat pad.

Removably mounted on each side of the yoke 42 is an elongated resilient cushion 50 which has a generally cylindrical surface and a length no greater than that of the straight section 46 of the yoke on which it is mounted. Each side cushion 50 is formed with an off-center longitudinal bore 52 and slit 54 which extends the length of the cushion through its external surface to the bore. Because the diameter of the bore is somewhat less than that of the yoke, the slit 54 forms an open wedge when the side cushion is slipped onto the yoke 42. Secured to each end of the side cushions 50 is the loop portion 59 of a hook-and-loop fastener, and a strap 56 containing the hook portion may be employed to tighten the side cushion to grip the yoke. When the straps are peeled back, the side cushions may be rotated to accommodate patients of differing hip sizes.

Figure 8:
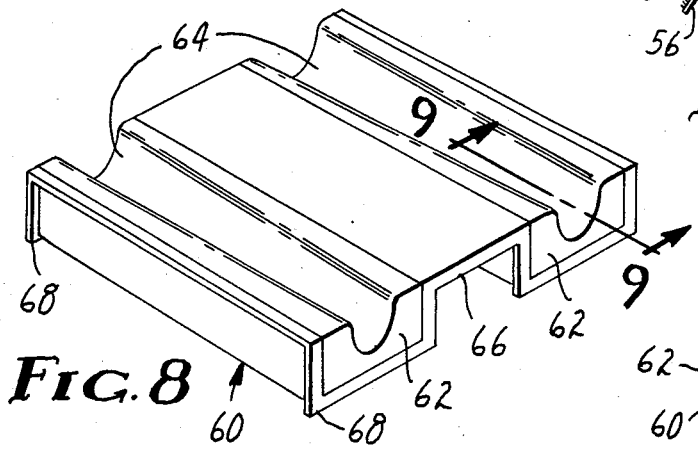
FIG. 8 is a schematic perspective of another lower-leg platform which is useful in a kneeling attachment of the invention.
Figure 9:
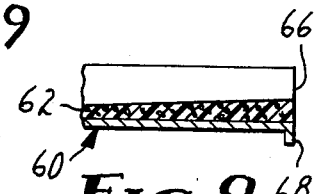
FIG. 9 is a cross-section along line 9—9 of FIG. 8.

FIGS. 8 and 9 show the panel portion of a lower-leg-supporting platform 60 that can be substituted for the lower-leg platform 12 of FIGS. 1, 2 and 6. The lower-leg platform 60 comprises a panel which is formed with a pair of rectangular depressions, into each of which is fitted a leg cushion 62. Each leg cushion is formed with a longitudinal channel 64 of substantially semi-circular cross section into which fits one of the legs of a patient. As seen in FIG. 9, each channel becomes more shallow toward the ankle end 66 of the lower-leg platform in order to conform to the anatomy of the leg. Across each of the ankle and knee ends along the underside of the lower-leg platform 60 is a reinforcing member 68, thus permitting the platform to be of lightweight construction.

Figure 10:
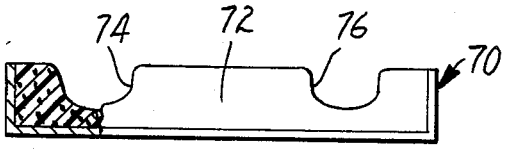
FIG. 10 is a view of the ankle end of another lower-leg platform of a kneeling attachment of the invention, partly broken away to a cross section near its knee end.

FIG. 10 shows the ankle end of another lower-leg platform 70 which comprises a panel formed with a single depression. Into the depression is fitted a single leg cushion 72 having two longitudinal channels 74 and 76, each of substantially circular cross section. The cross-sectional portion of FIG. 10 shows that the diameter of the channel 74 near its knee end is larger than at its ankle end.

Figure 11:
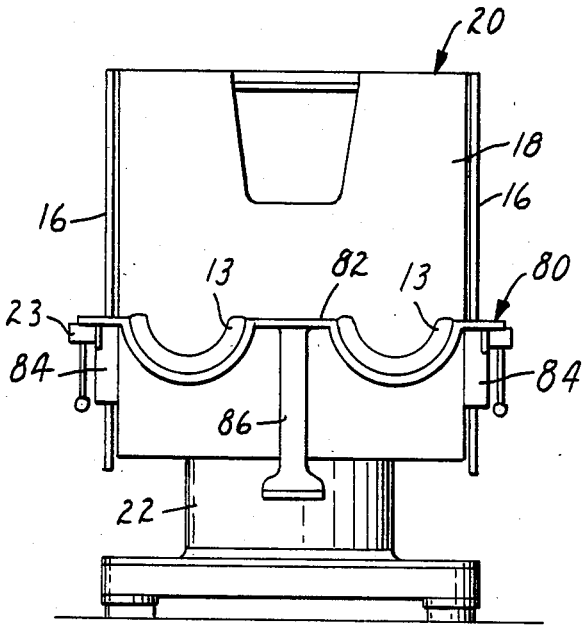
FIG. 11 is an end view of another kneeling attachment of the invention having only one post.

FIG. 11 shows another kneeling attachment 80 which has a lower-leg-supporting platform 82 that includes a pair of slides 84 riding on the side rails 16 of the foot 18 of the operating table 20. Attached to the lower-leg platform 82 is a single, central post 86 which extends downwardly when the foot is in the vertical position as shown. Because the post is not retractable, it should be as short as possible and yet of sufficient length to rest on the floor at the lowest position of the operating table 20 (or any other operating table with which the attachment may be used). By keeping the post short, the operating table can be moved through substantially its entire range of vertical movement without the post striking the floor.

The post 86 could be hinged for retraction or could be retracted in some other way, e.g., by telescoping.

Figure 12:
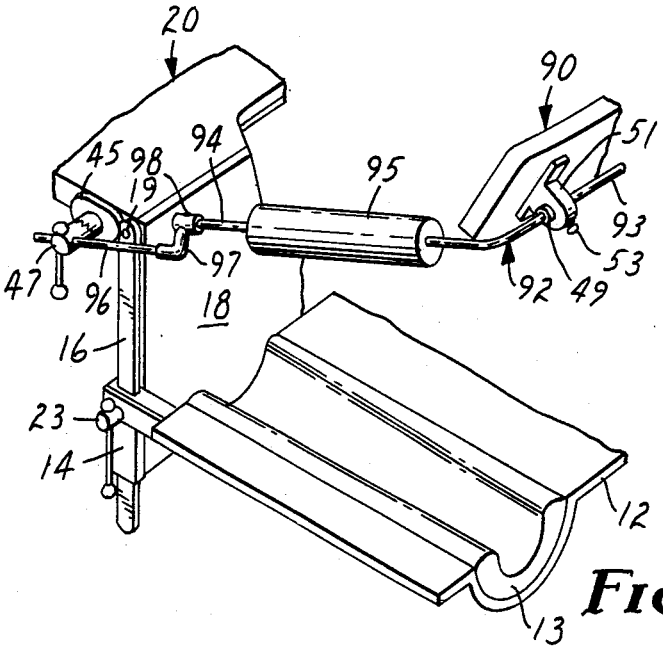
FIG. 12 shows a portion of a buttocks support which is constructed somewhat differently from that of FIG. 6.

FIG. 12 shows a portion of a buttocks support 90 which differs from the buttocks support 40 of FIG. 6 in that its U-shaped yoke 92 has five separable parts, the joints of which can be adjusted to fit operating tables of various widths. Of those five parts, a U-shaped central part 93 has two straight arms 94 (one shown), each carrying a cylindrical side cushion 95 formed with an off-center longitudinal bore. The other four parts are two rods 96 and two elbows 97 into which fit the ends of the arms 94. Upon removing the arms 94 from the elbows 97, the side cushions 95 can be slipped into place or removed and hence do not need to be slit lengthwise as are the side cushions 50 of FIG. 6. This makes the cushions easier to manufacture and eliminates any need for straps to tighten the cushions. After inserting an arm 94 into an elbow 97, they are locked together with a set screw 98 to establish a spacing between the rods 96 to permit the rods to be inserted squarely into the castellated mounts 45.

Each of the cushions 13, 50, 62, 72, and 95 is preferably a foamed plastic such as a semi-rigid, closed-cell polyurethane foam, and hence of low cost for economical disposability. By covering the plastic foam with a plastic-coated fabric, any of the cushions may be easily and thoroughly cleaned and hence reuseable. Any such covering preferably has a bacteriostatic coating.

We claim:

1. Kneeling attachment to an operating table which can be raised and lowered relative to the floor of an operating room and has a foot that can be in a vertical position and a rail along each side of the foot, said kneeling attachment having a rigid lower-leg-supporting platform including a slide riding on each of the rails, and means for releasably locking the slides to the rails, wherein the improvement comprises:

at least one post is attached to the lower-leg platform and, when said foot is in the vertical position, the post can rest on the floor to support a patient in the prone sitting position, thus permitting the slides to be unlocked and the operating table to be raised or lowered to position the patient's upper body relative to the buttocks.

2. Kneeling attachment as defined in claim 1 wherein said at least one post is a pair of rigidly interconnected posts which are hinged to pivot between a position extending downwardly, when said foot is in the vertical postion, and a retracted position.

3. Kneeling attachment as defined in claim 2 wherein each hinge includes means for automatically locking the hinge when pressure is longitudinally applied to the free ends of the posts while the posts are in said downwardly extending position.

4. Kneeling attachment as defined in claim 3 including means for fastening the the posts against the underside of the lower-leg platform when the posts are unlocked and retracted.

5. Kneeling attachment as defined in claim 4 having fixed to each post a hinge-pin which extends through a keyhole in a rigid arm that extends downwardly from the lower-leg platform when the foot of the operating table is in the vertical position, each hinge-pin having flat surfaces that can fit into the neck of the keyhole to lock the posts in the extended position.

6. Kneeling attachment as defined in claim 1 wherein each slide includes a clamp for releasably locking the slide to a rail along each side of the foot.

7. Kneeling attachment as defined in claim 6 and including releasable means for preventing the slides when unlocked from falling off the rails.

8. Kneeling attachment to an operating table which has at one end a foot that can be in a vertical position and a rigid lower-leg-supporting platform on which a patient kneels to assume the prone sitting position, said kneeling attachment including a buttocks support comprising:

a rigid U-shaped yoke, each arm of which can be telescopically locked to mounts on the operating table and has a straight section on which is removably mounted a resilient side cushion having a generally cylindrical surface, a length no greater than that of the straight section, and an off-center longitudinal bore into which the straight section fits and a seat pad pivotably mounted on the crosspiece of the yoke.

9. Buttocks support as defined in claim 8 including means for detachably clamping the seat pad to the crosspiece of the yoke.

10. Buttocks support as defined in claim 9 wherein said attaching means comprises a pair of C-shaped mounts on the seat pad and means for clamping the mounts to the yoke.

11. Buttocks support as defined in claim 10 wherein said clamping means include a collar fixed to the crosspiece of the yoke, each collar receives one of the C-shaped mounts, and each C-shaped mount includes a set screw for clamping the mount to its collar.

12. Buttocks support as defined in claim 8 wherein a slit extends the length of each side cushion through its surface to the bore to permit the cushion to be detachably slipped onto the yoke.

13. Buttocks support as defined in claim 12 wherein each of the yoke and bore is of circular cross section, and the diameter of the bore is less than that of the yoke, so that there is an open wedge at the slit when the side cushion is slipped onto the yoke.

14. Buttocks support as defined in claim 8 wherein the side cushions include strap means for tightening them against the yoke.

15. Kneeling attachment to an operating table which has at one end a foot that can be in a vertical position and a rigid lower-leg-supporting platform attached to the foot to extend substantially orthogonally to the foot, there being cushioning on the platform for the comfort of a patient who is kneeling on the platform, wherein the improvement comprises:

the cushioning is formed with two longitudinal channels of substantially semi-circular cross section, each channel being open at each end and constricted toward the ankle end to provide under and lateral support to the patient's lower leg over much of its length, and the kneeling attachment includes means spacing the lower-leg platform from the foot of the operating table to leave the kneecaps substantially unsupported.

16. Lower-leg-supporting platform as defined in claim 15 which is formed with a depression or depressions into which the cushioning fits to insure against sliding movement of the cushioning.

17. Lower-leg platform as defined in claim 16 wherein the cushioning comprises two leg cushions, each formed with a substantially semi-cylindrical channel.

18. Lower-leg platform as defined in claim 17 wherein each cushion is semi-rigid plastic foam.

19. Lower-leg platform as defined in claim 15 and further comprising a single, lightweight panel having reinforcing members beneath the panel across its knee and ankle ends.

* * * * *